US012208489B2

(12) United States Patent
Yamanaka et al.

(10) Patent No.: US 12,208,489 B2
(45) Date of Patent: Jan. 28, 2025

(54) METHOD OF GRINDING PLATE-SHAPED WORKPIECE

(71) Applicant: DISCO CORPORATION, Tokyo (JP)

(72) Inventors: Satoshi Yamanaka, Tokyo (JP); Hiroki Miyamoto, Tokyo (JP); Keisuke Nakano, Tokyo (JP); Ryo Shimazu, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 403 days.

(21) Appl. No.: 17/651,298

(22) Filed: Feb. 16, 2022

(65) Prior Publication Data

US 2022/0266406 A1 Aug. 25, 2022

(30) Foreign Application Priority Data

Feb. 22, 2021 (JP) ..... 2021-026124

(51) Int. Cl.
*B24B 7/02* (2006.01)

(52) U.S. Cl.
CPC ..... *B24B 7/02* (2013.01)

(58) Field of Classification Search
CPC .. B24B 7/02; B24B 7/228; B24B 7/14; B24B 37/10; B24B 37/107; B24B 37/005; B24B 37/04; B24B 37/042
USPC ..... 451/28
See application file for complete search history.

(56) References Cited

FOREIGN PATENT DOCUMENTS

| | | | | |
|---|---|---|---|---|
| JP | 63077647 | A | | 4/1988 |
| JP | 2010016181 | A | * | 1/2010 |
| JP | 2019038044 | A | | 3/2019 |
| JP | 2020171977 | A | | 10/2020 |
| KR | 20190021164 | A | * | 3/2019 |

OTHER PUBLICATIONS

Machine Translation KR 20190021164 A (Year: 2019).*
Machine Translation JP 2010016181A (Year: 2010).*
Search report issued in counterpart Singapore patent application No. 10202201515R, dated Jul. 25, 2023.
Japanese Patent Application [JP 2021-026124 A]: English translation of Notice of Reasons for Refusal, Sep. 17, 2024 (3 pages).

* cited by examiner

*Primary Examiner* — Eric J Rosen
*Assistant Examiner* — Robert C Moore
(74) *Attorney, Agent, or Firm* — Greer, Burns & Crain, Ltd.

(57) ABSTRACT

One array of grindstones is used for in-feed grinding and creep-feed grinding. Therefore, it is not necessary to position a chuck table that is holding a plate-shaped workpiece with respect to two different arrays of grindstones. As a result, a period of time required to grind the plate-shaped workpiece can be shortened. Furthermore, lower surfaces of the grindstones are used for the in-feed grinding, whereas side surfaces of the grindstones are used for the creep-feed grinding. Consequently, the amount by which the grindstones are worn can be smaller than that in a case where the plate-shaped workpiece is ground to a predetermined thickness in only the in-feed grinding or the creep-feed grinding.

13 Claims, 8 Drawing Sheets

METHOD OF GRINDING PLATE-SHAPED WORKPIECE

BACKGROUND OF THE INVENTION

Field of the Invention

The present invention relates to a method of grinding a plate-shaped workpiece.

Description of the Related Art

JP 1988-077647A discloses a method of grinding a wafer by performing in-feed grinding and then creep-feed grinding thereon.

SUMMARY OF THE INVENTION

According to the disclosed method, in-feed grindstones are used for in-feed grinding and creep-feed grindstones are used for creep-feed grinding. Since the two kinds of grindstones are used, it is necessary according to the method to spend a rather long, wasteful period of time to position a chuck table that is holding a wafer to be ground with respect to the two kinds of grindstones.

It is therefore an object of the present invention to provide a method of grinding a plate-shaped workpiece in a relatively short period of time when in-feed grinding and then creep-feed grinding are performed on the plate-shaped workpiece.

In accordance with an aspect of the present invention, there is provided a method of grinding a plate-shaped workpiece held on a holding surface of a chuck table with an annular array of grindstones. The method includes an in-feed grinding step of rotating the chuck table about a table rotational axis extending through a center of the holding surface that is holding the plate-shaped workpiece, positioning the grindstones above holding surface such that lower surfaces of the grindstones will move across the center of the holding surface and rotating the grindstones about a grindstone rotational axis extending through the center of the annular array of the grindstones, and moving the grindstones and the chuck table relatively to each other in directions perpendicular to the holding surface to grind an upper surface of the plate-shaped workpiece with the lower surfaces of the grindstones, and a creep-feed grinding step of positioning the lower surfaces of the grindstones used in the in-feed grinding step at a position outward of an outer peripheral edge of the plate-shaped workpiece and lower than the upper surface of the plate-shaped workpiece after the in-feed grinding step, stopping rotating the chuck table, and moving the plate-shaped workpiece and the grindstones relatively to each other in directions parallel to the holding surface to grind the upper surface of the plate-shaped workpiece with side surfaces of the rotating grindstones.

Preferably, the method further includes a pre-creep-feed grinding step to be carried out before the in-feed grinding step, in which the pre-creep-feed grinding step includes positioning the lower surfaces of the grindstones to be used in the in-feed grinding step at a position outward of the outer peripheral edge of the plate-shaped workpiece and lower than the upper surface of the plate-shaped workpiece, and moving the plate-shaped workpiece and the grindstones relatively to each other in directions parallel to the holding surface to grind the upper surface of the plate-shaped workpiece with side surfaces of the rotating grindstones.

Preferably, the method further includes a tilt changing step, to be carried out after the in-feed grinding step but before a start of the creep-feed grinding step, of tilting the grindstone rotational axis of the grindstones with respect to the holding surface from vertical directions slightly along the direction in which the plate-shaped workpiece is moved with respect to the grindstones in the creep-feed grinding step.

The method uses one array of grindstones for in-feed grinding and creep-feed grinding. Therefore, it is not necessary to position a chuck table that is holding a plate-shaped workpiece with respect to two different arrays of grindstones. As a result, the period of time required to grind the plate-shaped workpiece can be shortened.

Furthermore, lower surfaces of the grindstones are used for the in-feed grinding, whereas side surfaces of the grindstones are used for the creep-feed grinding. Consequently, an amount by which the grindstones are worn can be smaller than that in a case where the plate-shaped workpiece is ground to a predetermined thickness in only the in-feed grinding or the creep-feed grinding.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
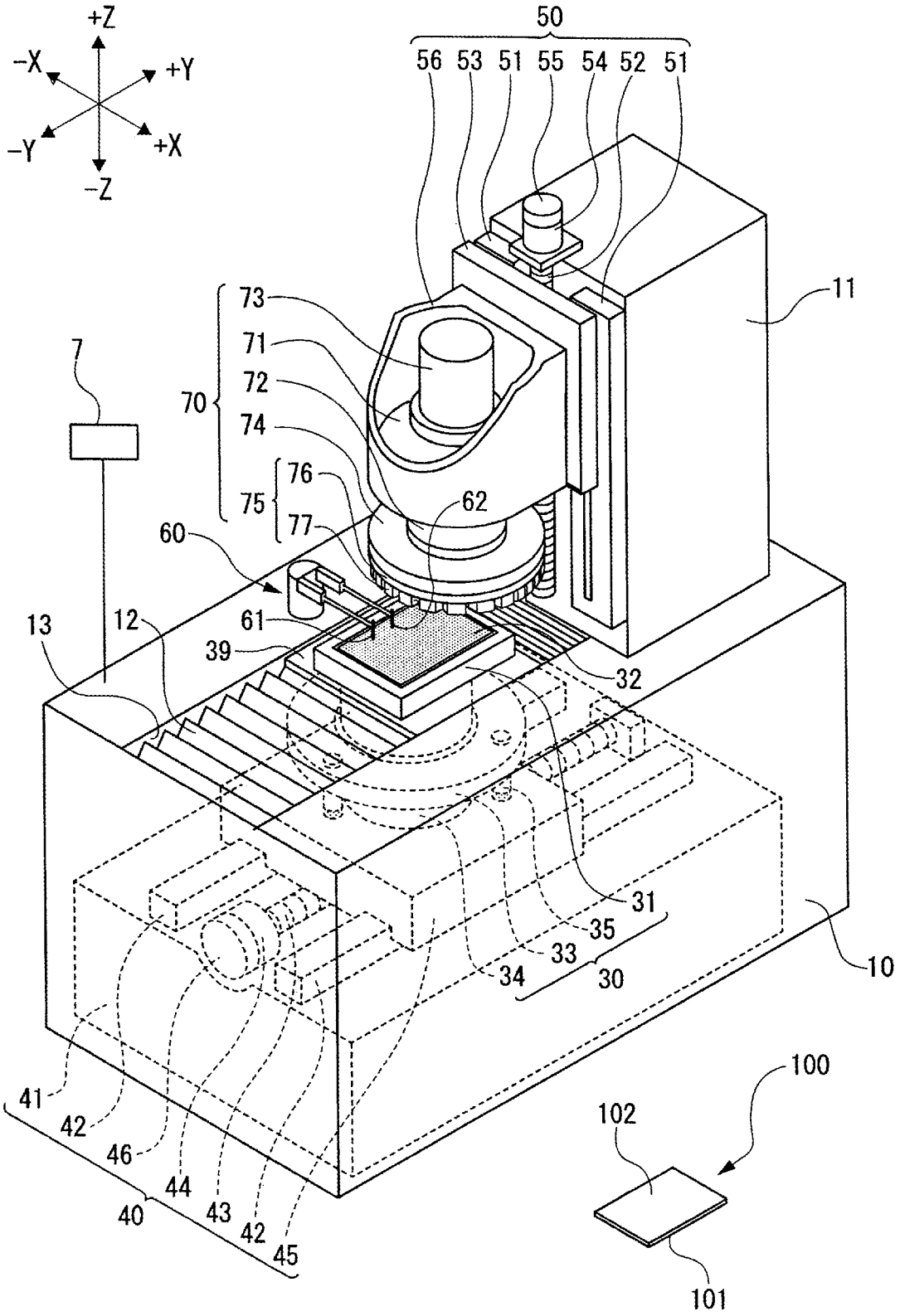
FIG. 1 is a perspective view illustrating the makeup of a grinding apparatus that carries out a method of grinding a plate-shaped workpiece according to an embodiment of the present invention.

As illustrated in FIG. 1, a grinding apparatus 1 operates to grind a plate-shaped workpiece 100. Stated otherwise, the grinding apparatus 1 carries out a method of grinding a plate-shaped workpiece, also referred to as "grinding method," according to an embodiment of the present invention. The plate-shaped workpiece 100 includes a quadrangular plate-shaped workpiece including a face side 101 and a reverse side 102.

In the description to be described below, an XYZ orthogonal coordinate system is established, and a positional relation of components will be described with reference to the XYZ orthogonal coordinate system. Directions lying within horizontal planes and extending along an X-axis of the XYZ orthogonal coordinate system will be referred to as X-axis directions, directions lying within the horizontal planes and extending along a Y-axis of the XYZ orthogonal coordinate system perpendicularly to the X-axis directions will be referred to as Y-axis directions, and directions lying within vertical planes and extending along the Z-axis of the XYZ orthogonal coordinate system perpendicularly to the X-axis directions and the Y-axis directions will be referred to as Z-axis directions. The X-axis directions include a +X direction and a −X direction that are opposite each other. The Y-axis directions include a +Y direction and a −Y direction that are opposite each other. The Z-axis directions include a +Z direction and a −Z direction that are opposite each other.

Figure 2A:
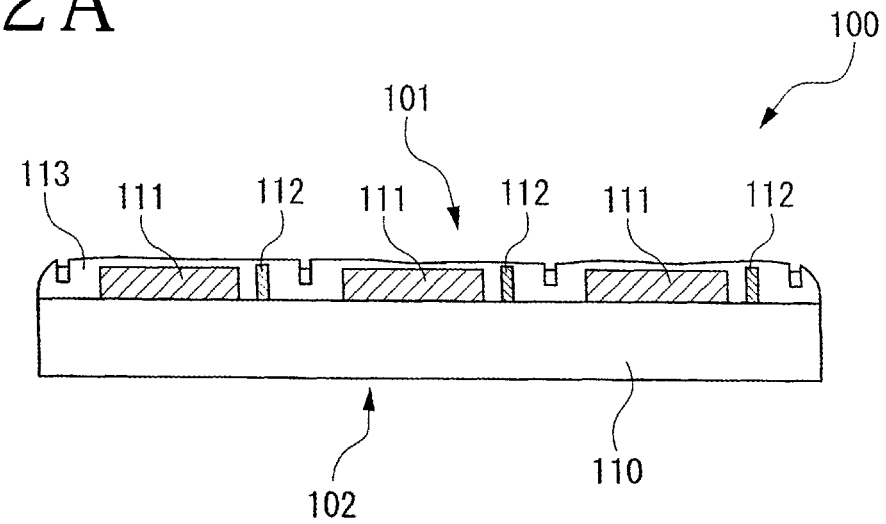
FIGS. 2A through 2C are cross-sectional views illustrating the method of grinding a plate-shaped workpiece according to the embodiment.

As illustrated in FIG. 2A, the plate-shaped workpiece 100 is of a composite structure including a quadrangular substrate 110 of polychlorinated biphenyl (PCB), a plurality of silicon (Si) chips 111, a plurality of electrodes 112 containing copper (Cu), and a molded resin layer 113. The Si chips 111 and the electrodes 112 are disposed in a grid pattern, for example, on the substrate 110. The molded resin layer 113 is disposed on the substrate 110 so as to encapsulate the Si chips 111 and the electrodes 112. The Si chips 111, the electrodes 112, and the molded resin layer 113 are formed on the face side 101 of the plate-shaped workpiece 100.

As illustrated in FIG. 1, the grinding apparatus 1 includes a base 10 shaped as a rectangular parallelepiped, a column 11 extending upwardly on the base 10, and a controller 7 for controlling various components of the grinding apparatus 1.

The base 10 has an opening 13 defined in an upper surface thereof. A workpiece holding mechanism 30 is disposed in the opening 13. The workpiece holding mechanism 30 includes a chuck table 31 having a holding surface 32 for holding the plate-shaped workpiece 100 thereon, a support member 33 that supports the chuck table 31 thereon, a chuck table motor 34 as a table rotating component for rotating the chuck table 31 and the support member 33 about their central axes, and a plurality of support posts 35 capable of adjusting a tilt of the chuck table 31.

The chuck table 31 is of a quadrangular shape having a quadrangular holding surface 32 on its upper surface. The chuck table 31 holds the plate-shaped workpiece 100 on the holding surface 32. The holding surface 32 is made of a porous material held in fluid communication with a suction source, not illustrated, which when actuated generates and applies a negative pressure to the holding surface 32 to attract the plate-shaped workpiece 100 under suction thereon.

When the chuck table motor 34 is energized, it rotates the chuck table 31 about its rotational axis aligned with a center of the holding surface 32. Specifically, the chuck table 31 with the plate-shaped workpiece 100 held on the holding surface 32 thereof is rotatable, together with the support member 33, by the chuck table motor 34 disposed therebelow about its rotational axis, i.e., a table rotational axis 301 (see FIG. 3), aligned with the center of the holding surface 32.

A cover plate 39 movable in the Y-axis directions in unison with the chuck table 31 is disposed around the chuck table 31. The cover plate 39 is coupled to a bellows cover 12 that is contractible and extensible in the Y-axis directions. A Y-axis moving mechanism 40 is disposed below the workpiece holding mechanism 30.

The Y-axis moving mechanism 40 moves the workpiece holding mechanism 30 and a grinding mechanism 70, to be described below, relatively to each other in the Y-axis directions parallel to the holding surface 32. According to the present embodiment, the Y-axis moving mechanism 40 is arranged to move the workpiece holding mechanism 30 that includes the chuck table 31 in the Y-axis directions with respect to the grinding mechanism 70.

The Y-axis moving mechanism 40 includes a pair of Y-axis guide rails 42 parallel to the Y-axis directions, a Y-axis movable table 45 slidably mounted on the Y-axis guide rails 42, a Y-axis ball screw 43 disposed between and extending parallel to the Y-axis guide rails 42, a Y-axis motor 44 connected to the Y-axis ball screw 43, a Y-axis encoder 46 for detecting a rotational angle of the Y-axis motor 44, and a holder base 41 holding the above components of the Y-axis guide rails 42 thereon.

Figure 3:
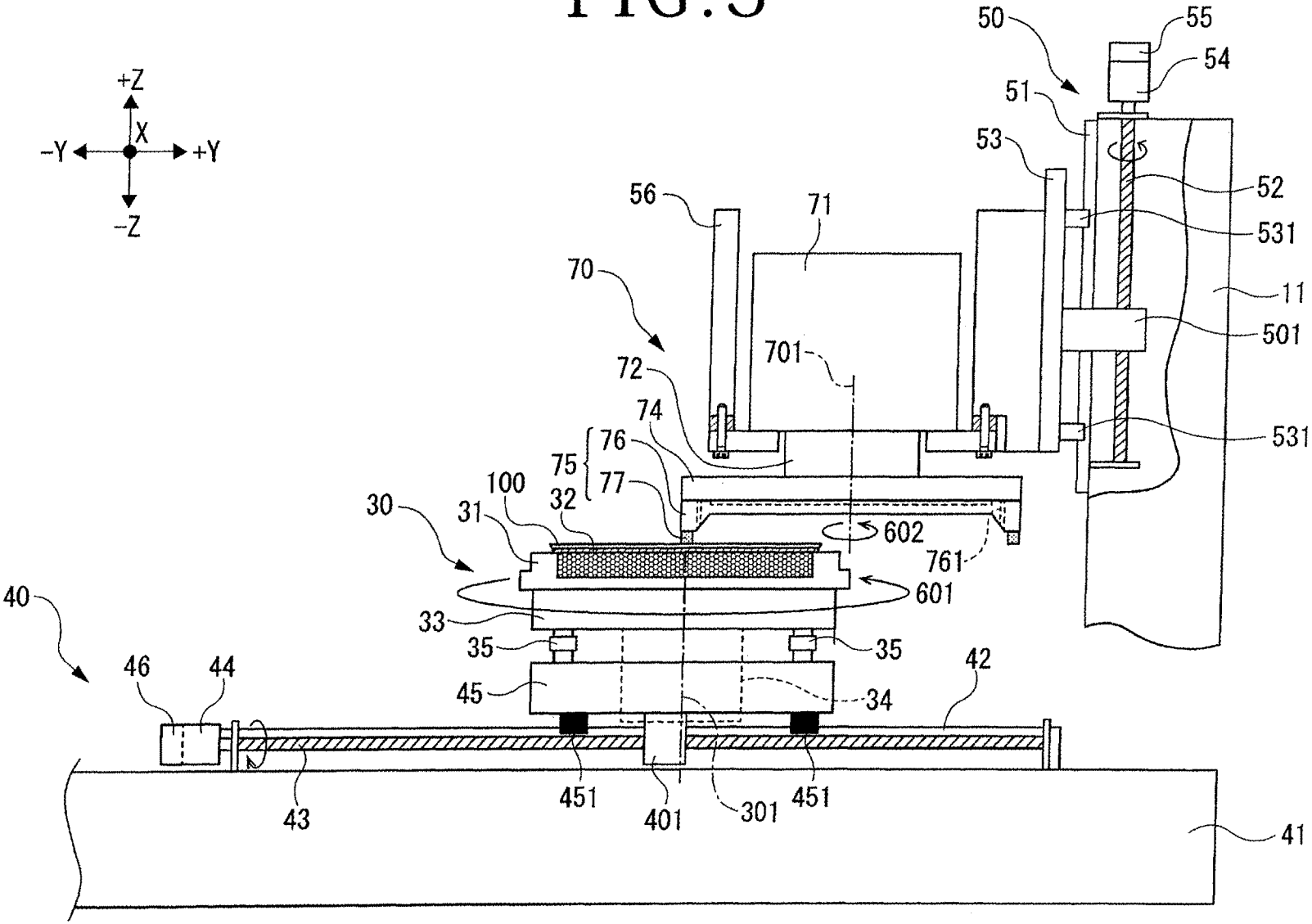
FIG. 3 is a side elevational view, partly in cross section, illustrating an in-feed grinding step of the method.

The Y-axis movable table 45 is slidably mounted on the Y-axis guide rails 42 by sliders 451 (see FIG. 3). A nut 401 (see FIG. 3) is fixed to a lower surface of the Y-axis movable table 45. The nut 401 is operatively threaded over the Y-axis ball screw 43. The Y-axis motor 44 is coupled to one end of the Y-axis ball screw 43.

The Y-axis moving mechanism 40 operates as follows. When the Y-axis motor 44 is energized, it rotates the Y-axis ball screw 43 about its central axis, causing the nut 401 to move the Y-axis movable table 45 in one of the Y-axis directions along the Y-axis guide rails 42. The support member 33 of the workpiece holding mechanism 30 is mounted on the Y-axis movable table 45 by the support posts 35. Therefore, as the Y-axis movable table 45 is moved in one of the Y-axis directions, the workpiece holding mechanism 30 including the chuck table 31 is also moved in the same Y-axis direction. The Y-axis encoder 46 detects the rotational angle of the Y-axis motor 44, thereby recognizing a position of the Y-axis movable table 45 in the Y-axis direction.

According to the present embodiment, the workpiece holding mechanism 30 is movable in the Y-axis directions by the Y-axis moving mechanism 40 generally between a front workpiece placing area situated in the −Y direction on the base 10 where the plate-shaped workpiece 100 is to be placed on the holding surface 32 and a rear grinding area situated in the +Y direction on the base 10 where the plate-shaped workpiece 100 is to be ground.

As illustrated in FIG. 1, the column 11 is erected on a rear portion of the base 10 that is situated in the +Y direction. The column 11 supports on its front surface the grinding mechanism 70 for grinding the plate-shaped workpiece 100 and a grinding feed mechanism 50.

The grinding feed mechanism 50 moves the workpiece holding mechanism 30 including the chuck table 31 and the grinding mechanism 70 relatively to each other in the Z-axis directions, also referred to as grinding feed directions, perpendicular to the holding surface 32. According to the present embodiment, the grinding feed mechanism 50 is arranged to move the grinding mechanism 70 in the Z-axis directions with respect to the chuck table 31.

The grinding feed mechanism 50 includes a pair of Z-axis guide rails 51 parallel to the Z-axis directions, a Z-axis movable table 53 slidably mounted on the Z-axis guide rails 51, a Z-axis ball screw 52 disposed between and extending parallel to the Z-axis guide rails 51, a Z-axis motor 54 connected to the Z-axis ball screw 52, a Z-axis encoder 55 for detecting the rotational angle of the Z-axis motor 54, and a holder 56 mounted on a front surface, i.e., a face side, of the Z-axis movable table 53. The holder 56 holds the grinding mechanism 70 thereon.

The Z-axis movable table 53 is slidably mounted on the Z-axis guide rails 51 by sliders 531 (see FIG. 3). A nut 501 (see FIG. 3) is fixed to a rear surface, i.e., a reverse side, of the Z-axis movable table 53. The nut 501 is operatively threaded over the Z-axis ball screw 52. The Z-axis motor 54 is coupled to one end of the Z-axis ball screw 52.

The grinding feed mechanism 50 operates as follows. When the Z-axis motor 54 is energized, it rotates the Z-axis ball screw 52 about its central axis, causing the nut 501 to move the Z-axis movable table 53 in one of the Z-axis directions along the Z-axis guide rails 51. Therefore, the holder 56 mounted on the Z-axis movable table 53 and the grinding mechanism 70 held on the holder 56 are also moved together with the Z-axis movable table 53 in the same Z-axis direction.

The Z-axis encoder 55 detects the rotational angle of the Z-axis motor 54, thereby recognizing a position of the Z-axis movable table 53 in the Z-axis direction.

As illustrated in FIG. 1, the grinding mechanism 70 includes a spindle housing 71 fixed to the holder 56, a spindle 72 rotatably housed in the spindle housing 71, a spindle motor 73 for rotating the spindle 72 about its central axis, a wheel mount 74 attached to the lower end of the spindle 72, and a grinding wheel 75 supported on the wheel mount 74.

The spindle housing 71 is held by the holder 56. The spindle 72 extends in the Z-axis directions and is rotatably supported by the spindle housing 71 for rotation about its central axis extending along the directions in which the spindle 72 extends, i.e., the Z-axis directions.

The spindle motor 73 is coupled to the upper end of the spindle 72 for rotating the spindle 72 about its central axis along the Z-axis directions.

The wheel mount 74 is shaped as a circular plate and fixed to the lower end, i.e., the distal end, of the spindle 72. The wheel mount 74 supports the grinding wheel 75 thereon.

The grinding wheel 75 is essentially equal in outside diameter to the wheel mount 74. The grinding wheel 75 includes an annular wheel base, i.e., an annular base, 76 made of a metal material. As illustrated in FIG. 3, the wheel base 76 has a water channel 761 defined therein for supplying processing water from a water source, not illustrated, to grindstones 77 on the wheel base 76.

As illustrated in FIG. 1, the grindstones 77 are fixed mounted in an annular array fully circumferentially on the lower surface of the wheel base 76. The annular array of the grindstones 77 has an inside diameter such that when the grindstones 77 are placed on the holding surface 32 of the chuck table 31, the grindstones 77 protrude outwardly from the holding surface 32.

The grindstones 77 are disposed on the lower surface of the wheel base 76 with the spindle 72 having its central axis aligned with the center of the annular array of the grindstones 77. When the grindstones 77 are placed in contact with the plate-shaped workpiece 100 held on the chuck table 31 in the rear grinding area and rotated about their central axis, i.e., a grindstone rotational axis 701 (see FIG. 3), by the spindle motor 73 through the spindle 72, the wheel mount 74, and the wheel base 76, the grindstones 77 grind the plate-shaped workpiece 100.

Specifically, when the grindstones 77 are rotated about the grindstone rotational axis 701 aligned with the center of the annular array of the grindstones 77, the grindstones 77 grind the face side 101 of the plate-shaped workpiece 100 held on the holding surface 32 of the chuck table 31 of the workpiece holding mechanism 30 disposed in the grinding area.

According to the present embodiment, the spindle 72 axially extends in the Z-axis directions, i.e., the directions perpendicular to the holding surface 32 of the chuck table 31. As described above, the spindle 72 has its central axis aligned with the grindstone rotational axis 701 about which the grindstones 77 are rotatable. According to the present embodiment, therefore, the grindstone rotational axis 701, i.e., the tilt with respect to the holding surface 32, is set to a direction perpendicular to the holding surface 32.

As illustrated in FIG. 1, a thickness measuring mechanism 60 is disposed on the base 10 on one side of the opening 13 in the base 10. The thickness measuring mechanism 60 can measure the thickness of the plate-shaped workpiece 100 held on the holding surface 32 in a contact fashion, i.e., while in contact with the plate-shaped workpiece 100.

Specifically, the thickness measuring mechanism 60 has a first probe 61 and a second probe 62 for contacting the holding surface 32 of the chuck table 31 and the plate-shaped workpiece 100, respectively. By placing the first probe 61 and the second probe 62 in contact with the holding surface 32 of the chuck table 31 and the plate-shaped workpiece 100, respectively, the thickness measuring mechanism 60 can measure the height of the holding surface 32 of the chuck table 31 and the height of the plate-shaped workpiece 100. The thickness measuring mechanism 60 can thus calculate the thickness of the plate-shaped workpiece 100 on the basis of the difference between the measured height of the holding surface 32 of the chuck table 31 and the measured height of the plate-shaped workpiece 100.

The thickness measuring mechanism 60 may include a non-contact distance measuring device, e.g., a laser distance measuring device, rather than the first probe 61 and the second probe 62. The laser distance measuring device applies a laser beam having a wavelength transmittable through the plate-shaped workpiece 100, for example, to the plate-shaped workpiece 100, detects a reflected beam from the lower surface, i.e., the reverse side 102, of the plate-shaped workpiece 100 and a reflected beam from the upper surface, i.e., the face side 101, of the plate-shaped workpiece 100, and measures the thickness of the plate-shaped workpiece 100 on the basis of the reflected beams.

The non-contact distance measuring device may use light or sound waves having a wavelength not transmittable through the plate-shaped workpiece 100 and the holding surface 32, for example. The non-contact distance measuring device that uses such light or sound waves can measure the height of the holding surface 32 and the height of the plate-shaped workpiece 100. The thickness measuring mechanism 60 that includes the non-contact distance measuring device can calculate the thickness of the plate-shaped workpiece 100 on the basis of the difference between the measured height of the holding surface 32 and the measured height of the plate-shaped workpiece 100.

The controller 7 includes a central processing unit (CPU) for performing arithmetic and processing operations according to control programs and a storage medium such as a memory. The controller 7 controls the components described above of the grinding apparatus 1 to perform a grinding process on the plate-shaped workpiece 100.

The grinding method according to the present embodiment on the grinding apparatus 1 will be described below.

The grinding method refers to a method of grinding the plate-shaped workpiece 100 held on the holding surface 32 of the chuck table 31 with the annular array of the grindstones 77. Various steps of the grinding step will successively be described below.

[Holding Step]

In the holding step, as illustrated in FIG. 3, the holding surface 32 of the chuck table 31 of the workpiece holding mechanism 30 holds the plate-shaped workpiece 100 thereon. Specifically, the controller 7 or the operator places the plate-shaped workpiece 100 with the face side 101 directed upwardly on the holding surface 32 of the chuck table 31 of the workpiece holding mechanism 30 disposed in the front workpiece placing area, so that the plate-shaped workpiece 100 is held on the holding surface 32. Thereafter, the controller 7 controls the Y-axis moving mechanism 40 to move the workpiece holding mechanism 30 including the chuck table 31 to the rear grinding area situated in the +Y direction on the base 10.

[In-Feed Grinding Step]

In the in-feed grinding step, the controller 7 controls the chuck table motor 34 of the workpiece holding mechanism 30 to rotate the chuck table 31 in a direction indicated by an arrow 601 about the table rotational axis 301 that extends through the center of the holding surface 32 on which the plate-shaped workpiece 100 is held, as illustrated in FIG. 3.

Then, the controller 7 controls the Y-axis moving mechanism 40 to position the grindstones 77 of the grinding mechanism 70 above the holding surface 32 such that the lower surfaces of the grindstones 77 will move across the center of the holding surface 32. The controller 7 controls the spindle motor 73 to rotate the spindle 72 about its central axis, thereby rotating the grindstones 77 about the grindstone rotational axis 701 in a direction indicated by an arrow 602.

Then, the controller 7 controls the grinding feed mechanism 50 to move the rotating grindstones 77 and the rotating chuck table 31 relatively to each other in the Z-axis directions perpendicular to the holding surface 32. According to the present embodiment, the controller 7 controls the grinding feed mechanism 50 to move the grindstones 77 with respect to the chuck table 31, i.e., toward the chuck table 31 in the −Z direction. The lower surfaces of the grindstones 77 are brought into abrasive contact with the upper surface, i.e., the face side 101, of the plate-shaped workpiece 100 on the holding surface 32, grinding the face side 101 of the plate-shaped workpiece 100.

Figure 2B:
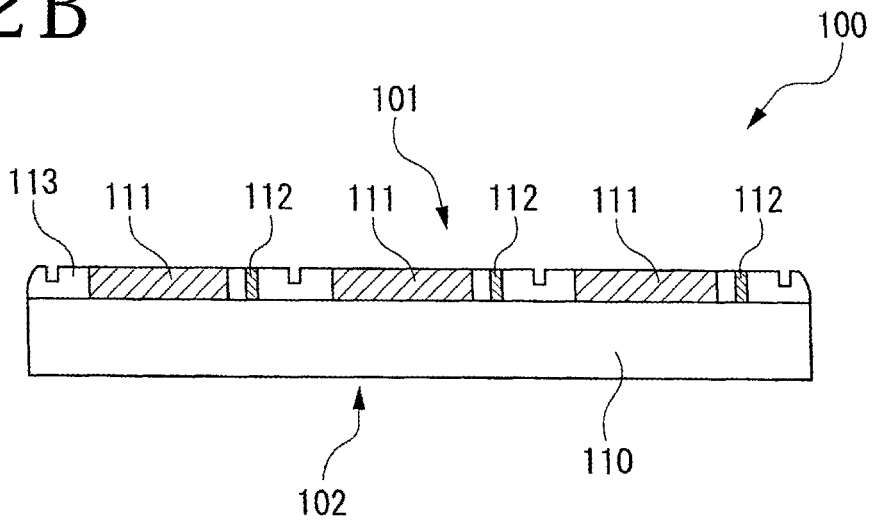

As illustrated in FIG. 2B, the portion of the molded resin layer 113 that covers the Si chips 111 and the electrodes 112 is thus ground away, making the Si chips 111 and the electrodes 112 appear on the face side 101. The Si chips 111, the electrodes 112, and the molded resin layer 113 are scraped off by a predetermined in-feed grinding quantity. The predetermined in-feed grinding quantity refers to a grinding quantity such that the thickness of the plate-shaped workpiece 100 will be a first target thickness after the in-feed grinding step.

In the in-feed grinding step, the thickness of the plate-shaped workpiece 100 that is being ground may be measured by the thickness measuring mechanism 60 illustrated in FIG. 1, and the plate-shaped workpiece 100 may be ground by way of in-feed grinding until the thickness of the plate-shaped workpiece 100 reaches the first target thickness.

[Creep-Feed Grinding Step]

Figure 4:
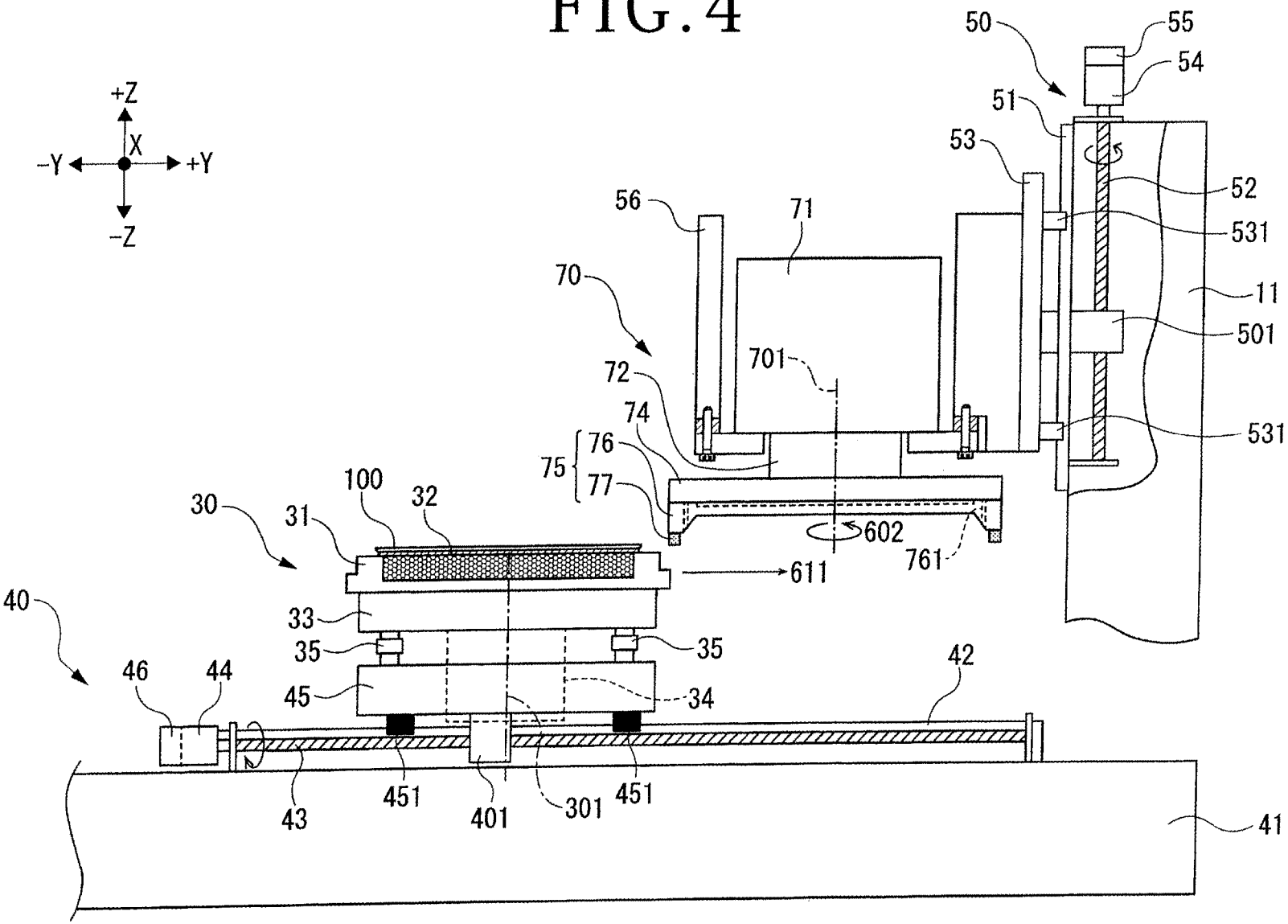
FIG. 4 is a side elevational view, partly in cross section, illustrating a creep-feed grinding step of the method.

The creep-feed grinding step is carried out after the in-feed grinding step. In the creep-feed grinding step, as illustrated in FIG. 4, the lower surfaces of the grindstones 77 used in the in-feed grinding step are positioned at a position outward of an outer peripheral edge of the plate-shaped workpiece 100 and lower than the upper surface, i.e., the face side 101, of the plate-shaped workpiece 100 (positioning process).

Specifically, the controller 7 controls the Y-axis moving mechanism 40 to place the workpiece holding mechanism 30 including the chuck table 31 in a front creep feed grinding start position in the −Y direction. The front creep feed grinding start position refers to a frontmost position in the −Y direction in the grinding area, for example, where the grindstones 77 are held out of contact with the plate-shaped workpiece 100 held on the chuck table 31, as illustrated in FIG. 4. At this time, the lower surfaces of the grindstones 77 are positioned outwardly horizontally of the outer peripheral edge of the plate-shaped workpiece 100 and the outer circumferential edge of the holding surface 32.

Then, the controller 7 determines a heightwise position, i.e., a ground heightwise position, of the lower surfaces of the grindstones 77 where the plate-shaped workpiece 100 will have a predetermined thickness after the creep-feed grinding step. The ground heightwise position refers to a position lower than the face side 101 of the plate-shaped workpiece 100 before the creep-feed grinding step. For example, the controller 7 determines the ground heightwise position from a preset thickness of the plate-shaped workpiece 100 after the creep-feed step, i.e., a final target thickness, or a second target thickness, of the plate-shaped workpiece 100, and the height of the holding surface 32 that has been acquired in advance.

Thereafter, the controller 7 controls the grinding feed mechanism 50 to move the grinding mechanism 70 including the grindstones 77 downwardly to set the heightwise position of the lower surfaces of the grindstones 77 as the ground heightwise position described above. The ground heightwise position may be set as follows. The height of the lower surfaces of the grindstones 77 after the in-feed grinding step is recognized by the Z-axis encoder 55 and stored, and then the grinding mechanism 70 including the grindstones 77 is moved downwardly from the stored height by a distance equal to the difference between the first target thickness and the second target thickness, after which the heightwise position of the lower surfaces of the grindstones 77 is set as the ground heightwise position described above.

At the same time that the grindstones 77 are thus positionally controlled or before or after the grindstones 77 are thus positionally controlled, the controller 7 controls the chuck table motor 34 to stop rotating the chuck table 31.

Then, the controller 7 moves the plate-shaped workpiece 100 and the grindstones 77 relatively to each other in directions parallel to the holding surface 32. According to the present embodiment, the controller 7 controls the Y-axis moving mechanism 40 to move the workpiece holding mechanism 30 including the chuck table 31 that is holding the plate-shaped workpiece 100 toward the grindstones 77 as indicated by an arrow 611 in FIG. 4 (chuck table moving process).

Figure 2C:
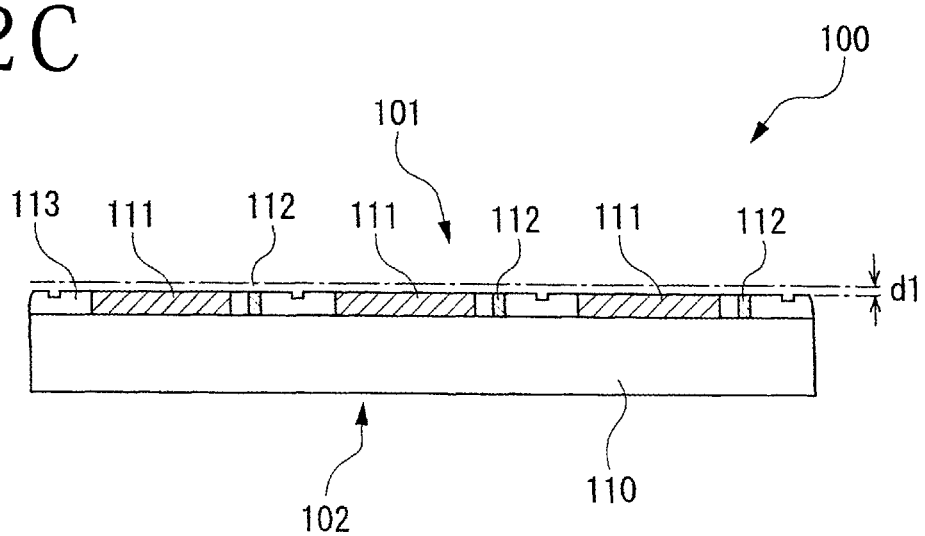

The upper surface, i.e., the face side 101, of the plate-shaped workpiece 100 is now brought into abrasive contact with the side surfaces of the rotating grindstones 77, so that the face side 101 of the plate-shaped workpiece 100 are ground by the grindstones 77. As illustrated in FIG. 2C, the Si chips 111, the electrodes 112, and the molded resin layer 113 on the face side 101 of the plate-shaped workpiece 100 are further scraped off by a thickness d1 after the in-feed grinding step until the thickness of the plate-shaped workpiece 100 reaches the second target thickness referred to above.

In the creep-feed grinding step, the controller 7 controls the thickness measuring mechanism 60 illustrated in FIG. 1 to measure the thickness of the plate-shaped workpiece 100 being ground. The controller 7 finishes the creep-feed grinding step after confirming that the measured thickness of the plate-shaped workpiece 100 has reached the second target thickness. If the measured thickness of the plate-shaped workpiece 100 has not reached the second target thickness, then the controller 7 carries out the creep-feed grinding step again.

According to the present embodiment, as described above, the same grindstones 77 are used in the in-feed grinding step and the creep-feed grinding step. Therefore, it is not necessary to position the chuck table 31 that is holding the plate-shaped workpiece 100 with respect to two different annular arrays of grindstones. As a result, the period of time required to grind the plate-shaped workpiece 100 in the in-feed grinding step and the creep-feed grinding step can be shortened.

Furthermore, the lower surfaces of the grindstones 77 are used in the in-feed grinding step, whereas the side surfaces of the grindstones 77 are used in the creep-feed grinding step. Consequently, the amount by which the grindstones 77 are worn can be smaller, and the grindstones 77 are less likely to be loaded, than that in a case where the plate-shaped workpiece 100 is ground to a predetermined thickness in only the in-feed grinding step or the creep-feed grinding step. The service life of the grindstones 77 is thus extended.

Figure 5:
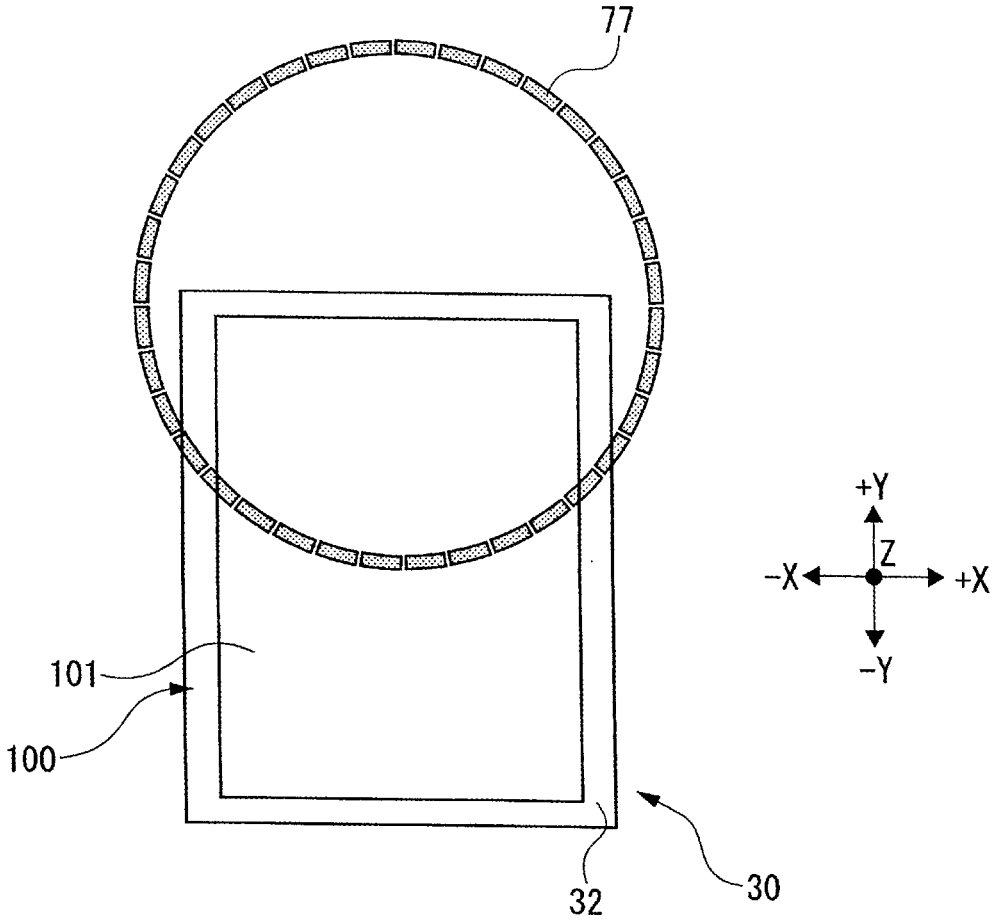
FIG. 5 is a plan view illustrating a positional relation between grindstones and the plate-shaped workpiece in the in-feed grinding step.

According to the present embodiment, since the creep-feed grinding step is carried out after the in-feed grinding step, the following advantages are obtained. When the annular array of the grindstones 77 grinds the plate-shaped workpiece 100 held on the holding surface 32 of the chuck table 31 in the in-feed grinding step, the grindstones 77 are positioned so as to protrude horizontally from the plate-shaped workpiece 100, as illustrated in FIG. 5.

Figure 6:
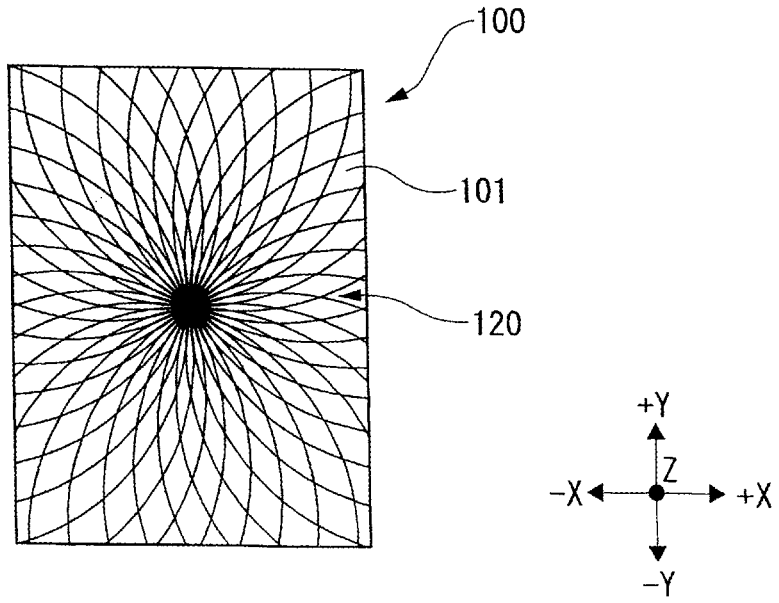
FIG. 6 is a schematic view illustrating in-feed grinding marks.

When the in-feed grinding step illustrated in FIG. 3 is then carried out, the grindstones 77 leave in-feed grinding marks 120 (see FIG. 6) on the ground face side 101 of the plate-shaped workpiece 100. As illustrated in FIG. 6, the distances between the in-feed grinding marks 120 are progressively larger toward the outer peripheral edge of the face side 101 of the plate-shaped workpiece 100. Therefore, after the in-feed grinding step, the face side 101 of the plate-shaped workpiece 100 has surface irregularities that are progressively larger toward the outer peripheral edge of the plate-shaped workpiece 100.

As a consequence, after the in-feed grinding step, the plate-shaped workpiece 100 has its mechanical strength liable to vary from place to place. Therefore, if the plate-shaped workpiece 100 is divided into small segments as semiconductor chips each including an Si chip 111 by a cutting blade after the in-feed grinding step, then the semiconductor chips are difficult to have a uniform flexural strength.

Figure 7:
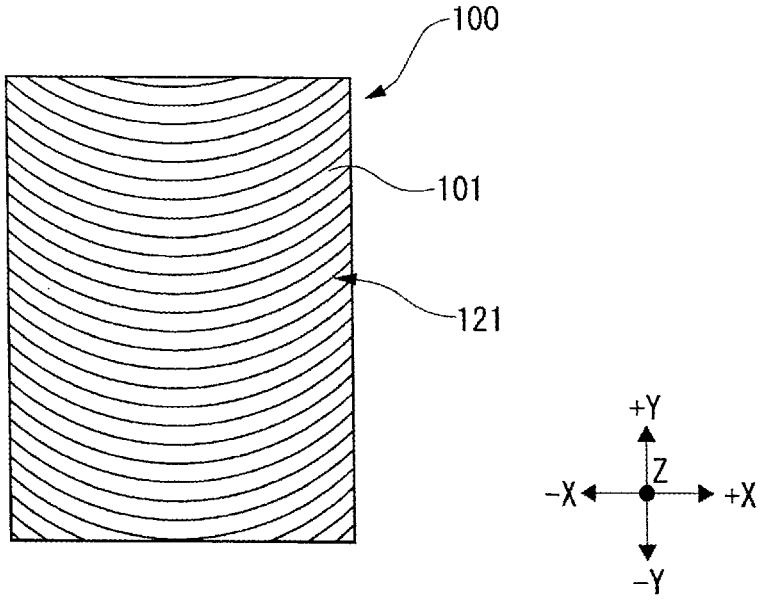
FIG. 7 is a schematic view illustrating creep-feed grinding marks.

On the other hand, when the creep-feed grinding step is carried out, as illustrated in FIG. 4, the grindstones 77 leave arcuate creep-feed grinding marks 121 (see FIG. 7) on the face side 101 of the plate-shaped workpiece 100. As illustrated in FIG. 7, the in-creep grinding marks 121 are continuously spaced apart at essentially equal intervals on the face side 101 of the plate-shaped workpiece 100. Consequently, inasmuch as the creep-feed grinding step is carried out after the in-feed grinding step according to the present embodiment, semiconductor chips produced as segments cut from the ground plate-shaped workpiece 100 have a uniform flexural strength.

According to the present embodiment, the controller 7 may carry out a pre-creep-feed grinding step, to be described below, before the in-feed grinding step described above.

[Pre-Creep-Feed Grinding Step]

In the pre-creep-feed grinding step according to the present embodiment, the face side 101 of the plate-shaped workpiece 100 is ground until the Si chips 111 and the electrodes 112 appear on the face side 101 at a predetermined ratio.

The pre-creep-feed grinding step includes the same process as part of the creep-feed grinding step. In the pre-creep-feed grinding step, specifically, the controller 7 positions the lower surfaces of the grindstones 77 at a position outward of the outer peripheral edge of the plate-shaped workpiece 100 and lower than the upper surface, i.e., the face side 101, of the plate-shaped workpiece 100 (positioning process), as illustrated in FIG. 4.

Specifically, the controller 7 controls the Y-axis moving mechanism 40 to place the workpiece holding mechanism 30 including the chuck table 31 in the front creep feed grinding start position in the −Y direction referred to above. The lower surfaces of the grindstones 77 are positioned horizontally outwardly of the outer peripheral edge of the plate-shaped workpiece 100 and the outer circumferential edge of the holding surface 32.

Furthermore, the controller 7 controls the set the heightwise position of the lower surfaces of the grindstones 77 as the ground heightwise position lower than the face side 101 of the plate-shaped workpiece 100. The ground heightwise position is lower than the face side 101 of the plate-shaped workpiece 100 before it is ground. For example, the controller 7 determines the ground heightwise position on the basis of the height of the plate-shaped workpiece 100 before it is ground and a predetermined pre-creep-feed grinding quantity, i.e., a quantity to be ground off in the pre-creep-feed grinding step.

Then, the controller 7 moves the plate-shaped workpiece 100 and the grindstones 77 relatively to each other in directions parallel to the holding surface 32. Specifically, the controller 7 controls the Y-axis moving mechanism 40 to move the workpiece holding mechanism 30 including chuck table 31 that is holding the plate-shaped workpiece 100 in the +Y direction toward the grindstones 77 as indicated by the arrow 611 in FIG. 4 (chuck table moving process).

Figure 8A:
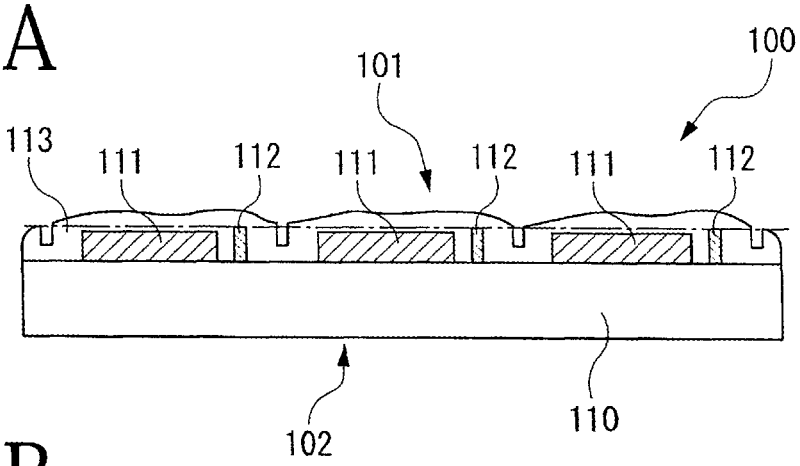
FIGS. 8A through 8D are cross-sectional views illustrating another method of grinding a plate-shaped workpiece according to the present invention.
Figure 8B:
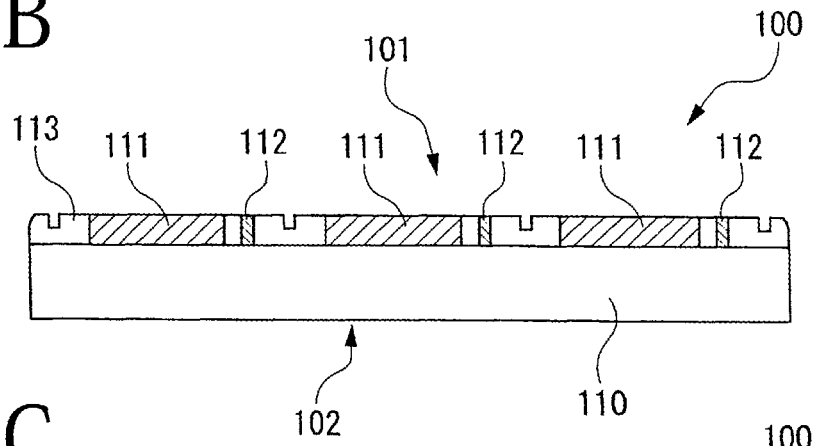

In this manner, the controller 7 grinds the upper surface, i.e., the face side 101, of the plate-shaped workpiece 100 with the side surfaces of the rotating grindstones 77. The plate-shaped workpiece 100 in the state illustrated in FIG. 8A before it is ground is now ground as illustrated in FIG. 8B.

Specifically, in the pre-creep-feed grinding step, on the face side 101 of the plate-shaped workpiece 100, mainly the molded resin layer 113 is scraped off, making the Si chips 111 and the electrodes 112 appear on the face side 101 at a predetermined ratio.

Figure 8C:
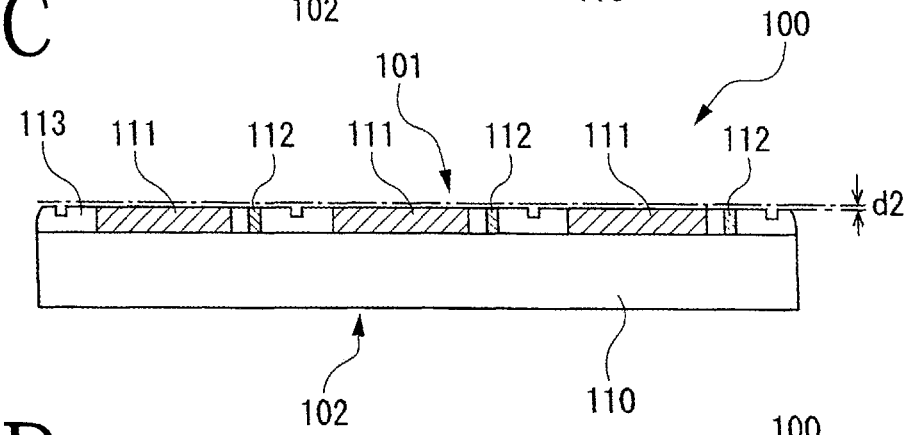

Thereafter, the controller 7 carries out the in-feed grinding step described above. As illustrated in FIG. 8C, the face side 101 of the plate-shaped workpiece 100 is further scraped off by a thickness d2 after the pre-creep-feed grinding step, so that the thickness of the plate-shaped workpiece 100 reaches the first target thickness referred to above.

Figure 8D:
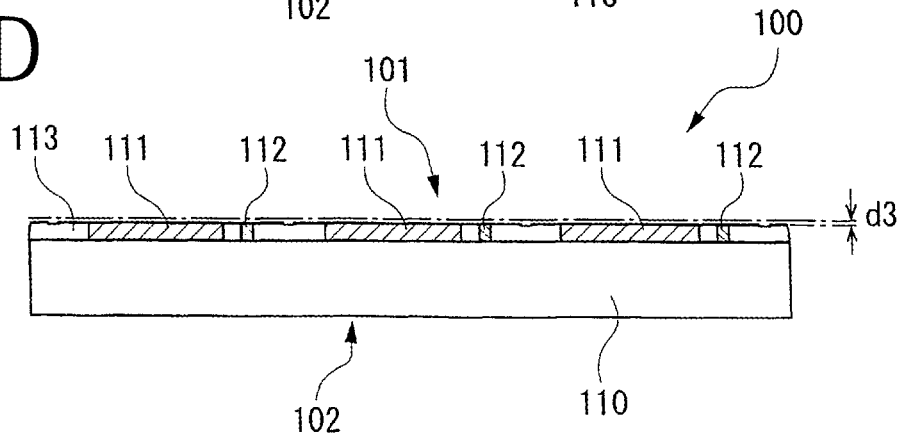

Moreover, the controller 7 carries out the creep-feed grinding step described above. As illustrated in FIG. 8D, the face side 101 of the plate-shaped workpiece 100 is further scraped off by a thickness d3 after the in-feed grinding step, so that the thickness of the plate-shaped workpiece 100 reaches the second target thickness referred to above.

The pre-creep-feed grinding quantity, i.e., the quantity to be ground off in the pre-creep-feed grinding step, will be described below. In the pre-creep-feed grinding step, as described above, the molded resin layer 113 is partly scraped off until the Si chips 111 and the electrodes 112 appear on the face side 101 of the plate-shaped workpiece 100 at a predetermined ratio.

Before starting to carry out the pre-creep-feed grinding step, the controller 7 measures the total thickness of the plate-shaped workpiece 100. Then, the controller 7 compares "the sum the of thickness (designed value) of the substrate 110 and the thickness (designed value) of the Si chips 111" and "the sum of the thickness (designed value) of the substrate 110 and the height (designed value) of the electrodes 112" with each other, and selects the larger sum. The controller 7 sets a value that is calculated by subtracting the selected sum from the measured total thickness of the plate-shaped workpiece 100, as the pre-creep-feed grinding quantity.

Thus, the controller 7 calculates the pre-creep-feed grinding quantity from the designed values representing the thicknesses of the substrate 110, the Si chips 111, and the electrodes 112 and the measured total thickness of the plate-shaped workpiece 100, and grinds the face side 101 of the plate-shaped workpiece 100 by a thickness commensurate with the calculated pre-creep-feed grinding quantity. In the pre-creep-feed grinding step, therefore, the Si chips 111 and the electrodes 112 appear on the face side 101 at the predetermined ratio.

The pre-creep-feed grinding step that is carried out prior to the in-feed grinding step offers the following advantages. In case the amount of the molded resin layer 113 of the plate-shaped workpiece 100 is large, i.e., in case the total thickness of the plate-shaped workpiece 100 is large and the molded resin layer 113 on the surface thereof has relatively large surface irregularities, an excessive portion of the molded resin layer 113 can be removed all together in the pre-creep-feed grinding step. Therefore, the quantity to be ground away from the plate-shaped workpiece 100 and the period of time required to grind the plate-shaped workpiece 100 in the in-feed grinding step can be reduced. As a result, the total period of time required to grind the plate-shaped workpiece 100 can be shortened.

In the pre-creep-feed grinding step, the controller 7 may use a camera, not illustrated, to capture an image of the face side 101 of the workpiece 100 after the pre-creep feed grinding step, and may confirm whether the Si chips 111 and the electrodes 112 have appeared on the face side 101 at the predetermined ratio or not on the basis of the captured image.

Providing the camera is used, the controller 7 may perform a plurality of creep-feed grinding sessions in the pre-creep-feed grinding step. In this case, the controller 7 sets the grinding quantity in each of the creep-feed grinding sessions to a small level and grinds the face side 101 of the plate-shaped workpiece 100 in the creep-feed grinding sessions. In each of the creep-feed grinding sessions, the controller 7 controls the camera to capture an image of the face side 101 to recognize the ratio at which the Si chips 111 and the electrodes 112 have appeared on the face side 101. If the recognized ratio has reached a predetermined ratio, then the controller 7 finishes the pre-creep-feed grinding step.

According to the present embodiment, the grinding mechanism 70 of the grinding apparatus 1 may have a grindstone rotational axis adjusting mechanism (not illustrated) for adjusting the tilt of the grindstone rotational axis 701 of the grindstones 77 with respect to the holding surface 32. The grindstone rotational axis adjusting mechanism adjusts the tilt of the grindstone rotational axis 701 by adjusting the directions in which the spindle 72 extends, i.e., the tilt of the spindle 72, for example.

Providing the grinding mechanism 70 has the grindstone rotational axis adjusting mechanism, the controller 7 controls the grindstone rotational axis adjusting mechanism in the in-feed grinding step to adjust the tilt of the grindstone rotational axis 701 of the grindstones 77 so as to be perpendicular to the holding surface 32 of the chuck table 31. The controller 7 may carry out a tilt changing step, to be described below, after the in-feed grinding step and before a start of the creep-feed grinding step.

[Tilt Changing Step]

Figure 9:
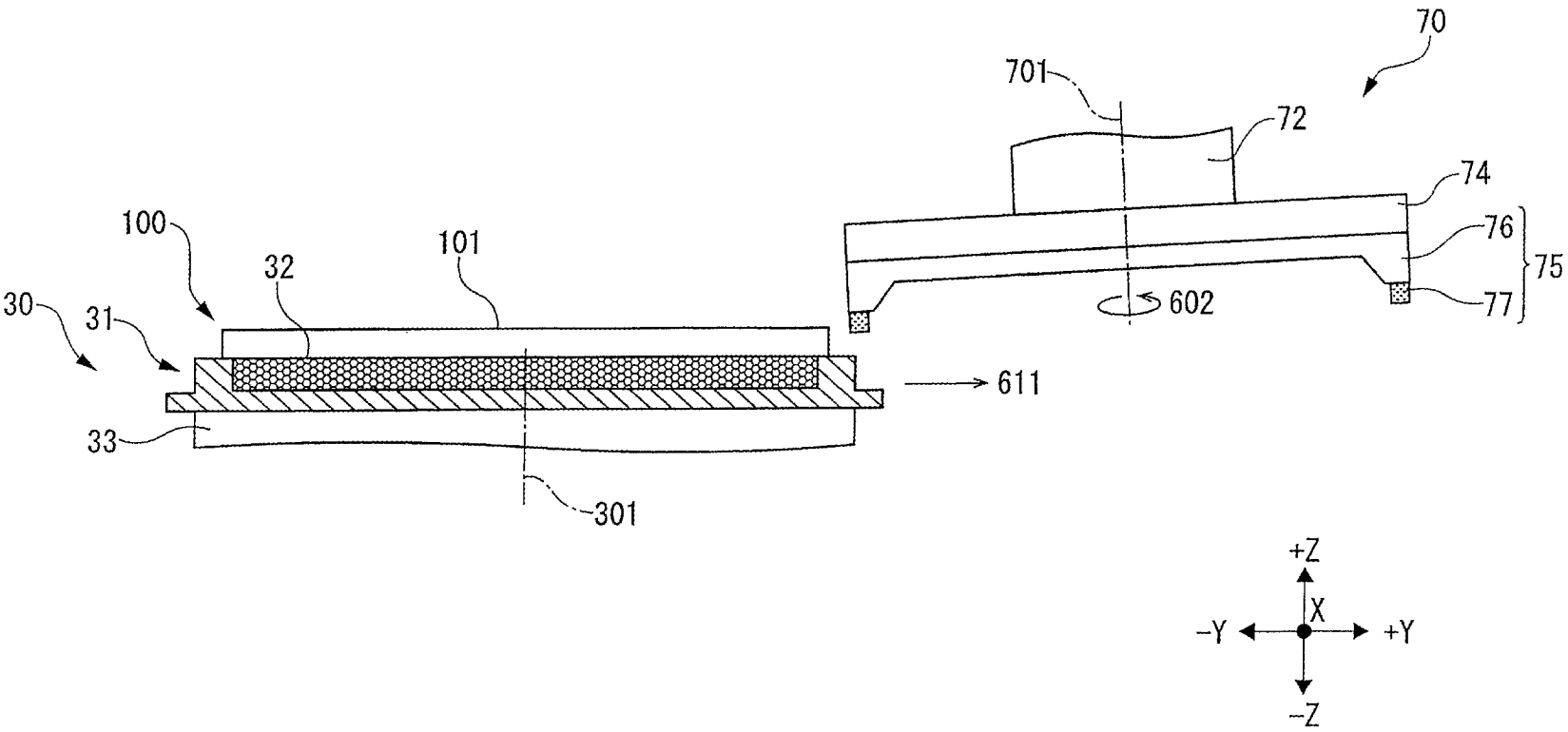
FIG. 9 is a cross-sectional view illustrating a tilt changing step of tilting a rotational axis of the grindstones.

In the tilt changing step, the controller 7 controls the grindstone rotational axis adjusting mechanism to tilt the grindstone rotational axis 701 of the grindstones 77 with respect to the holding surface 32 from the vertical directions slightly along the direction in which the plate-shaped workpiece 100 is moved with respect to the grindstones 77 in the direction indicated by the arrow 611 in FIG. 9 in the creep-feed grinding step. The grindstones 77 are thus tilted with respect to the chuck table 31 in the direction in which the plate-shaped workpiece 100 is moved with respect to the grindstones 77, i.e., in the +Y direction. Then, the grindstones 77 grinds the face side 101 of the plate-shaped workpiece 100 on the holding surface 32 in the subsequent creep-feed grinding step.

According to the present embodiment, as illustrated in FIG. 9, the controller 7 controls the grindstone rotational axis adjusting mechanism to tilt the grindstones 77 such that the side of the grindstones 77 that extends in the +Y direction is higher than the other side thereof. Therefore, in the creep-feed grinding step, the side of the grindstones 77 that extends in the −Y direction grinds the plate-shaped workpiece 10. In other words, the side surfaces of the grindstones 77 on the side thereof in the −Y direction grind the plate-shaped workpiece 100.

When the chuck table 31 is replaced with another chuck table, the grindstones 77 is tilted such that the side of the grindstones 77 that extends in the +Y direction is higher than the other side thereof, as described above, and the side of the rotating grindstones 77 that extends in the −Y direction is brought into abrasive contact with the chuck table 31, thereby grinding the upper surface thereof to form a holding surface 32 thereon.

The controller 7 may control the grindstone rotational axis adjusting mechanism to tilt the grindstones 77 such that the side of the grindstones 77 that extends in the −Y direction is higher than the other side thereof. In this case, the side of the grindstones 77 that extends in the +Y direction grinds the plate-shaped workpiece 100. In other words, the inner side surfaces of the grindstones 77 on the side thereof in the +Y direction grind the plate-shaped workpiece 100. The tilt changing step may also be carried out prior to the pre-creep-feed grinding step.

According to the present embodiment, the chuck table 31 is of the quadrangular shape with the quadrangular holding surface 32 on its upper surface. However, the chuck table 31 and the holding surface 32 thereof may be of a circular shape.

According to the present embodiment, the holding surface 32 of the chuck table 31 holds a single plate-shaped workpiece 100 thereon at one time. However, the holding surface 32 may be arranged to hold a plurality of plate-shaped workpieces 100 thereon at the same time.

According to the present embodiment, furthermore, the plate-shaped workpiece 100 is of a quadrangular shape by way of example. However, the grinding apparatus 1 according to the present invention may hold a polygonal or circular workpiece made of different materials arranged thicknesswise on the holding surface 32 and may grind the workpiece with the grindstones 77.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of grinding a plate-shaped workpiece held on a holding surface of a chuck table with an annular array of grindstones, comprising:

an in-feed grinding step of rotating the chuck table about a table rotational axis extending through a center of the holding surface that is holding the plate-shaped workpiece, positioning the grindstones above the holding surface such that lower surfaces of the grindstones will move across the center of the holding surface and rotating the grindstones about a grindstone rotational axis extending through the center of the annular array of the grindstones, and moving the grindstones and the chuck table relatively to each other in directions perpendicular to the holding surface to grind a face side of the plate-shaped workpiece to a first target thickness with the lower surfaces of the grindstones; and a creep-feed grinding step of positioning the lower surfaces of the grindstones used in the in-feed grinding step at a position outward of an outer peripheral edge of the plate-shaped workpiece, and lower than the face side of the plate-shaped workpiece by a distance equal to a difference between the first target thickness and a second target thickness, after the in-feed grinding step, stopping rotating the chuck table, and moving the plate-shaped workpiece and the grindstones relatively to each other in directions parallel to the holding surface to grind the entire face side of the plate-shaped workpiece to the second target thickness, with side surfaces of the rotating grindstones.

2. The method according to claim 1, further comprising:

a pre-creep-feed grinding step to be carried out before the in-feed grinding step, wherein the pre-creep-feed grinding step includes positioning the lower surfaces of the grindstones to be used in the in-feed grinding step at a position outward of the outer peripheral edge of the plate-shaped workpiece and lower than the face side of the plate-shaped workpiece, and moving the plate-shaped workpiece and the grindstones relatively to each other in directions parallel to the holding surface to grind the face side of the plate-shaped workpiece with side surfaces of the rotating grindstones.

3. The method according to claim 1, further comprising:

a tilt changing step, to be carried out after the in-feed grinding step but before a start of the creep-feed grinding step, of tilting the grindstone rotational axis of the grindstones with respect to the holding surface and with respect to the face side of the plate-shaped workpiece held on the holding surface of the chuck table from vertical directions slightly along the direction in which the plate-shaped workpiece is moved with respect to the grindstones in the creep-feed grinding step.

4. The method according to claim 1, wherein in the creep-feed grinding step, a controller finishes the creep-feed grinding step after confirming that a measured thickness of the plate-shaped workpiece has reached the second target thickness; and if the measured thickness of the plate-shaped workpiece has not reached the second target thickness, the controller carries out the creep-feed grinding step again.

5. The method according to claim 3, wherein in the pre-creep-feed grinding step, a plurality of creep-feed grinding sessions are performed;

a camera is controlled by a controller to capture an image of the face side of the plate-shaped workpiece to recognize a ratio at which silicon chips and electrodes have appeared on the face side of the plate-shaped workpiece; and if the ratio recognized has reached a predetermined ratio, then the controller finishes the pre-creep-feed grinding step.

6. The method according to claim 1, wherein after the creep-feed grinding step, the grindstones leave arcuate creep-feed grinding marks on the upper surface of the workpiece.

7. The method according to claim 6, wherein the creep-feed grinding marks are continuously spaced apart at essentially equal intervals on the upper surface of the workpiece.

8. The method according to claim 1, wherein the workpiece has a rectangular shape and having a long dimension and a short dimension, the annular array of grindstones has an inside diameter larger than the short dimension of the workpiece.

9. A method of grinding a plate-shaped workpiece held on a holding surface of a chuck table with an annular array of grindstones, the workpiece having a face side and a reverse side, the workpiece comprising a plurality of chips and electrodes covered on the face side with a resin layer, comprising:

an in-feed grinding step of rotating the chuck table about a table rotational axis extending through a center of the holding surface that is holding the plate-shaped workpiece, positioning the grindstones above the holding surface such that lower surfaces of the grindstones will move across the center of the holding surface and rotating the grindstones about a grindstone rotational axis extending through the center of the annular array of the grindstones, and moving the grindstones and the chuck table relatively to each other in directions perpendicular to the holding surface to grind the face side of the plate-shaped workpiece with the lower surfaces of the grindstones until at least some of the chips and electrodes are exposed on the face side of the workpiece; and a creep-feed grinding step of positioning the lower surfaces of the grindstones used in the in-feed grinding step at a position outward of an outer peripheral edge of the plate-shaped workpiece and lower than the face side of the plate-shaped workpiece after the in-feed grinding step, stopping rotating the chuck table, and moving the plate-shaped workpiece and the grindstones relatively to each other in directions parallel to the holding surface to grind the face side of the plate-shaped workpiece with side surfaces of the rotating grindstones to thereby grind away portions of the chips and electrodes.

10. The method according to claim 9, further comprising:

a pre-creep-feed grinding step to be carried out before the in-feed grinding step, wherein the pre-creep-feed grinding step includes positioning the lower surfaces of the grindstones to be used in the in-feed grinding step at a position outward of the outer peripheral edge of the plate-shaped workpiece and lower than the face side of the plate-shaped workpiece, and moving the plate-shaped workpiece and the grindstones relatively to each other in directions parallel to the holding surface to grind the face side of the plate-shaped workpiece with side surfaces of the rotating grindstones.

11. The method according to claim 9, further comprising:

a tilt changing step, to be carried out after the in-feed grinding step but before a start of the creep-feed grinding step, of tilting the grindstone rotational axis of the grindstones with respect to the holding surface and with respect to the face side of the plate-shaped workpiece held on the holding surface of the chuck table from vertical directions slightly along the direction in which the plate-shaped workpiece is moved with respect to the grindstones in the creep-feed grinding step.

12. The method according to claim 9, wherein after the creep-feed grinding step, the grindstones leave arcuate creep-feed grinding marks on the face side of the workpiece.

13. The method according to claim 12, wherein the creep-feed grinding marks are continuously spaced apart at essentially equal intervals on the face side of the workpiece.

* * * * *